US005547118A

United States Patent [19]

Candiracci

[11] Patent Number: 5,547,118

[45] Date of Patent: Aug. 20, 1996

[54] QUICK-ADJUSTMENT SLEWING DEVICE FOR INSERTING AND CUTTING CROSS WIRES IN AUTOMATIC EQUIPMENT FOR PREFABRICATING BUILDING PANELS

[76] Inventor: Angelo Candiracci, Via Rosciano, 44, 61032 Fano PS, Italy

[21] Appl. No.: 263,122

[22] Filed: Jun. 21, 1994

[30] Foreign Application Priority Data

Jun. 21, 1993 [IT] Italy ..... PS93A0011

[51] Int. Cl.[6] ..... B21F 27/10

[52] U.S. Cl. ..... 228/5.1; 228/13; 140/112; 227/79; 29/897.32

[58] Field of Search ..... 29/897.32, 897.34; 228/5.1, 13; 140/3 C, 112; 227/26, 79

[56] References Cited

U.S. PATENT DOCUMENTS 4,505,019 3/1985 Deinzer ..... 29/897.32

4,831,699 5/1989 Rozzi ..... 29/897.34

FOREIGN PATENT DOCUMENTS

308837A1 3/1989 European Pat. Off. ..... 140/112

*Primary Examiner*—P. Austin Bradley
*Assistant Examiner*—Jeffrey T. Knapp
*Attorney, Agent, or Firm*—Cohen, Pontani, Lieberman, Pavane

[57] ABSTRACT

A slewing device having a quickly adjustable drive is available for inserting and cutting cross wires in automated equipment for the prefabrication of building panels. The device includes a bridge that may be selectively tilted to planes transverse to the line of conveyance of the panels supported by a bank of electronically-controlled electric motor drives. Each drive motor operates a corresponding device for pulling at least one metal wire so as to push and insert the wire at substantially any angle through a layer of plastic material sandwiched between sheets of wire netting to form the panel after passing through coaxial cutting devices for trimming the wire after its insertion.

17 Claims, 7 Drawing Sheets

QUICK-ADJUSTMENT SLEWING DEVICE FOR INSERTING AND CUTTING CROSS WIRES IN AUTOMATIC EQUIPMENT FOR PREFABRICATING BUILDING PANELS

BACKGROUND OF THE INVENTION

1. Field of the Invention

The present invention relates to a slewing device for inserting and cutting cross wires in automatic equipment for the prefabrication of building panels. More particularly, the present invention relates to a slewing device, for such inserting and cutting, which can be quickly adjusted.

2. Discussion of the Prior Art

Sandwich-type building panels are now available made of expanded plastic and wire netting: prefabricated structures consisting substantially of a layer of expanded plastic material, usually polystyrene, between two sheets of wire netting mutually connected through electric welding by a number of cross wires passing through this layer, to be utilized after being coated with plaster, and placed side by side to define hollow spaces for pouring a concrete mix in order to create walls, floors and the like in building construction.

Equipment already exists, as described in European patent No. 0,038,837 and U.S. Pat. No. 4,917,284, for the automatic production of these building panels, and in particular for automatically inserting the cross wires into the layer of expanded plastic and welding them at both ends to the netting on the two faces of the layer.

This equipment, while functional, is relatively difficult to regulate when the format of the panel varies in thickness.

Moreover, this equipment is poorly adapted to the insertion of pairs of cross wires on each pass.

Finally, the equipment does not permit insertion of the cross wires at an angle.

OBJECTS AND SUMMARY OF THE INVENTION

It is accordingly an object of the present invention to provide devices that can be quickly adjusted and are capable of pulling and inserting, through a layer of expanded plastic forming a panel, one or a plurality of metal wires at practically any angle in automatic building panel prefabrication equipment.

Another object of the invention is to achieve the preceding objective by means of devices that permit the unit to be adjusted as quickly, simply and immediately as possible when the format of the panels to be stapled is varied.

Another object of the invention is to achieve the preceding objectives by simple and effective means that are safe to use and relatively economical considering the practical results obtained.

The present invention achieves these objects by providing a quick-adjustment slewing device for inserting and cutting cross wires in automatic equipment for the prefabrication of building panels. The device includes a bridge that can be tilted to planes transverse to the line of conveyance of the panels supporting a bank of electronically-controlled electric motor drives. Each motor drive operates corresponding means for pulling at least one metal wire in order to push it and insert it at substantially any angle through the layer of plastic material positioned between sheets of wire netting constituting the panel after passing through coaxial cutting devices operable for trimming at least one wire after its insertion.

The various features of novelty which characterize the invention are pointed out with particularity in the claims annexed to and forming a part of the disclosure. For a better understanding of the invention, its operating advantages, and specific objects attained by its use, reference should be had to the accompanying drawings and descriptive matter in which there are illustrated and described, by way of example, currently preferred embodiments of the invention.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
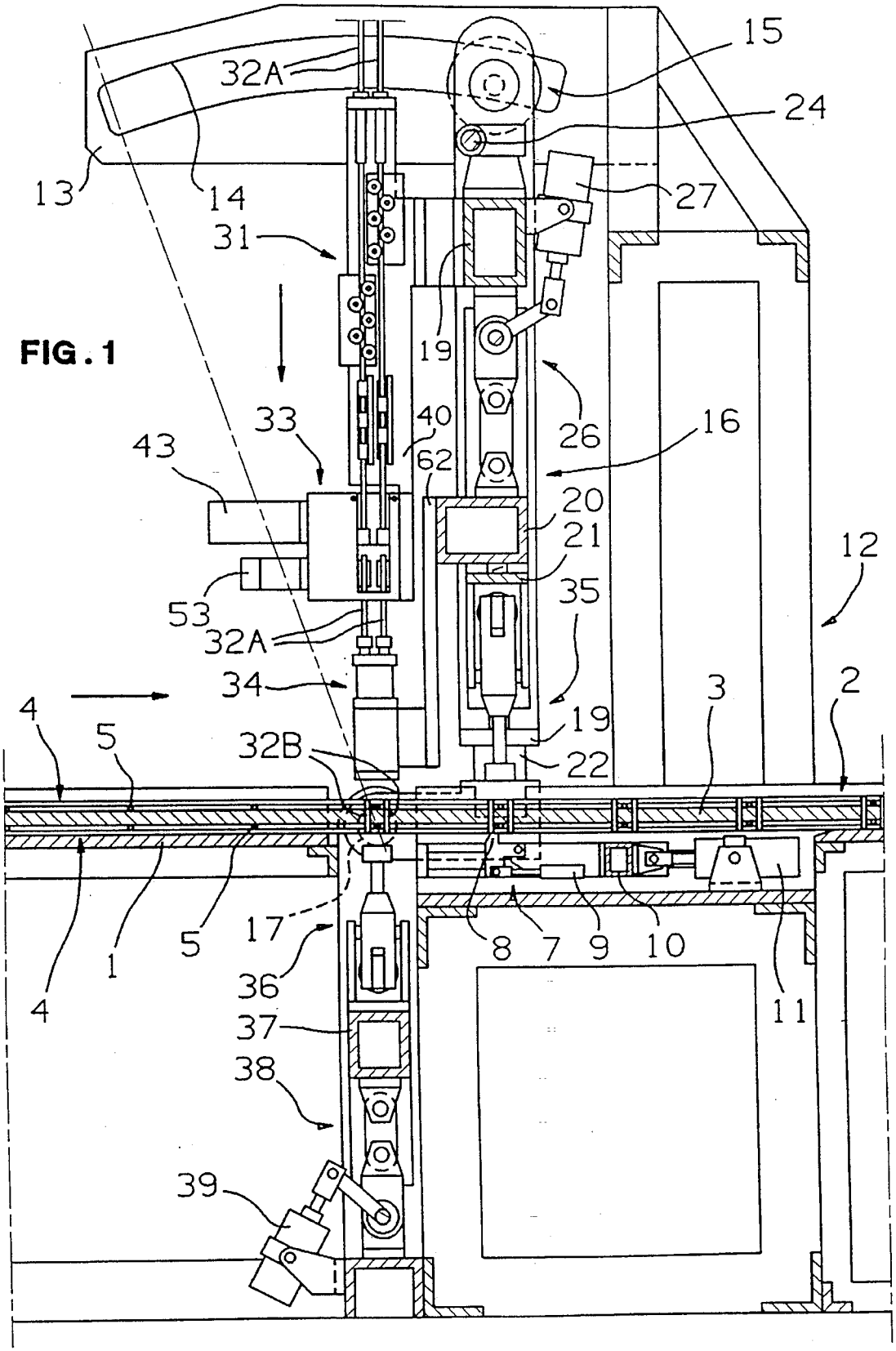
FIG. 1 is a cross-sectional side view of automated equipment for the prefabrication of sandwich building panels formed of wire netting and expanded plastic, and incorporating a device constructed in accordance with the present invention.
Figure 8:
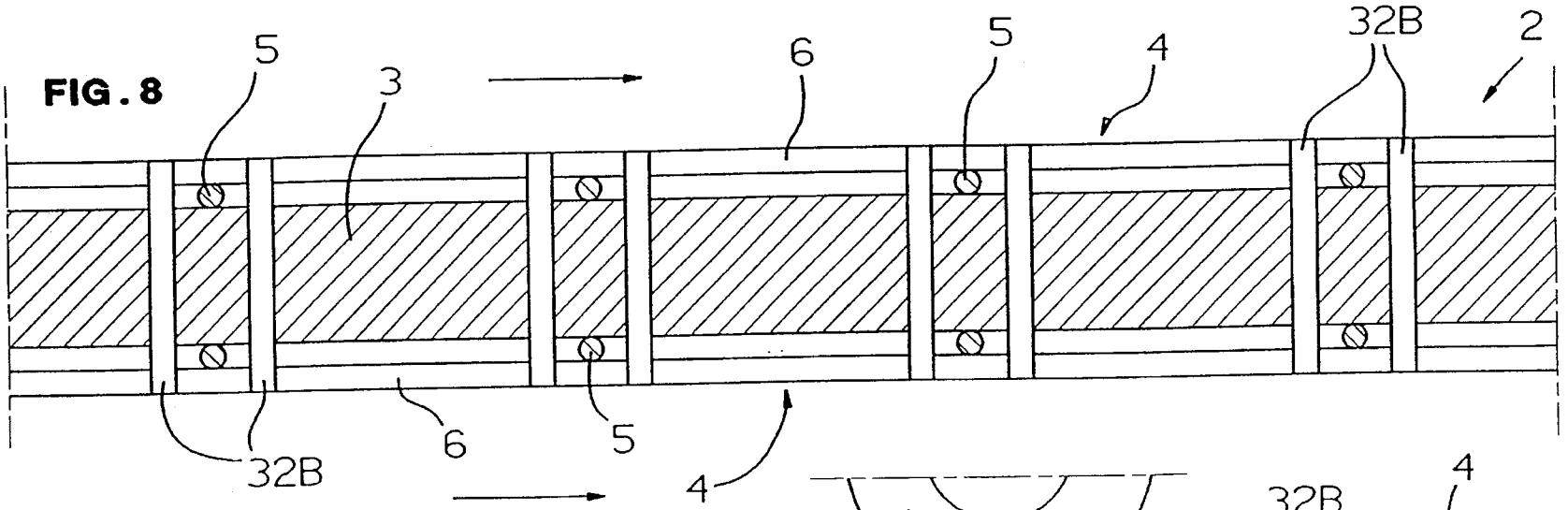
FIG. 8 is a side cross-sectional view of a sandwich panel formed of wire mesh and expanded plastic with pairs of cross wires inserted therethrough in accordance with an operating alternative of the device of the present invention.

FIG. 1 depicts an automated apparatus or equipment for the prefabrication of building panels 2, including a conveyor platform 1 for the panels 2. The panels 2 are formed of a layer of expanded plastic 3 between electrically-welded rectangular wire nets 4 consisting of transversal warp wires 5 criss-crossed by longitudinal weft wires 6 (also see FIGS. 8 and 9).

The panels 2 are caused to move in a jogging, i.e. inching, motion on the conveyor platform 1 by means of an advancing device 7 located under the conveyor and consisting of hooks 8 pushed up and away by means of pneumatic pistons 9 and also linked by a bar 10 that transmits to them the horizontal alternating movement provided by a pneumatic device 11.

Above the conveyor platform 1 is a frame 12 comprising two symmetrical lateral plates 13 equipped respectively with arched slots 14 in which a tilting bridge 16 is engaged at the top by means of air brakes 15 and is hinged at the bottom at hinges 17 to two sides of the conveyor platform, and is driven there by a geared motor 18.

Figure 2:
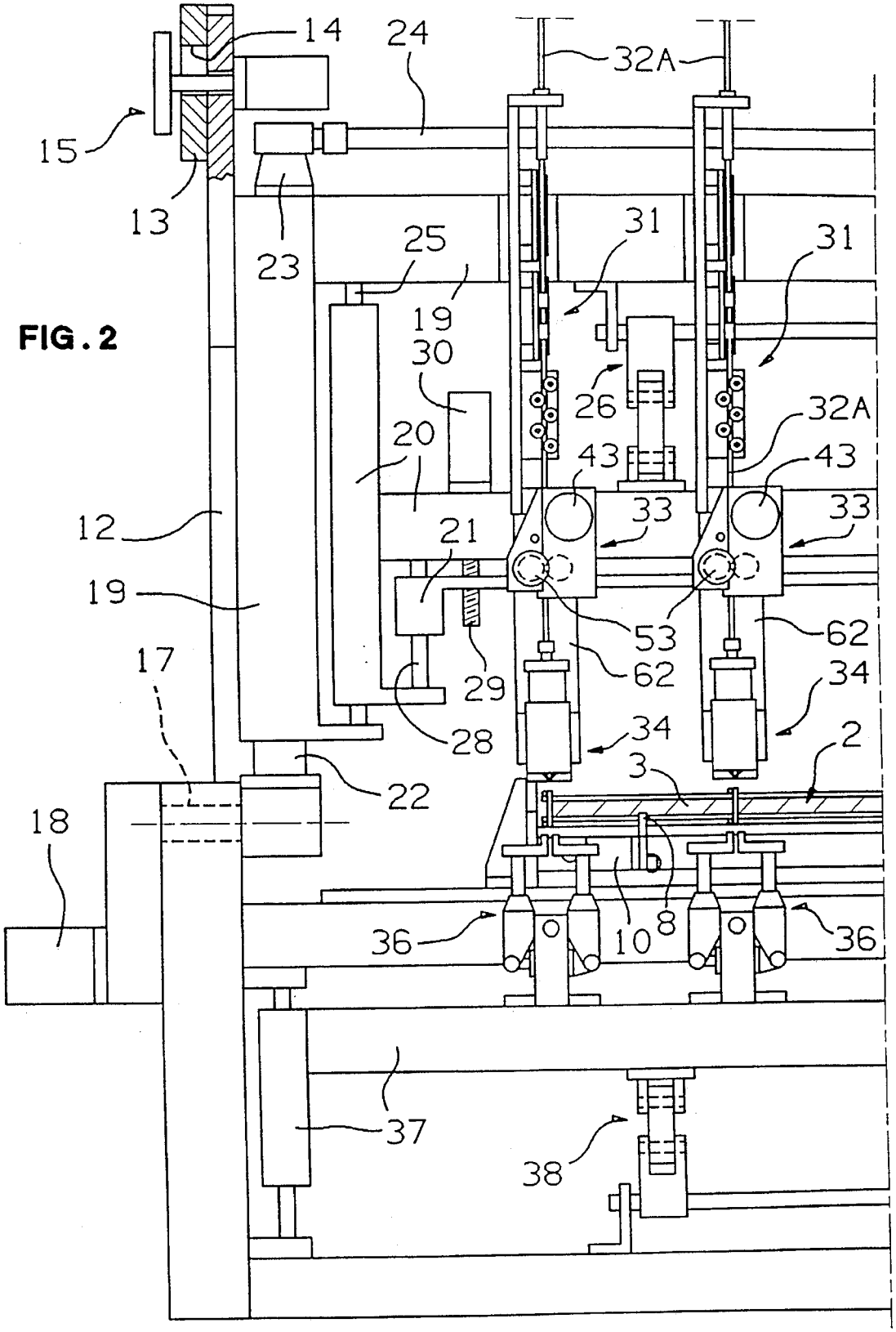
FIG. 2 is a partial front view of the automated equipment of FIG. 1.
Figure 3:
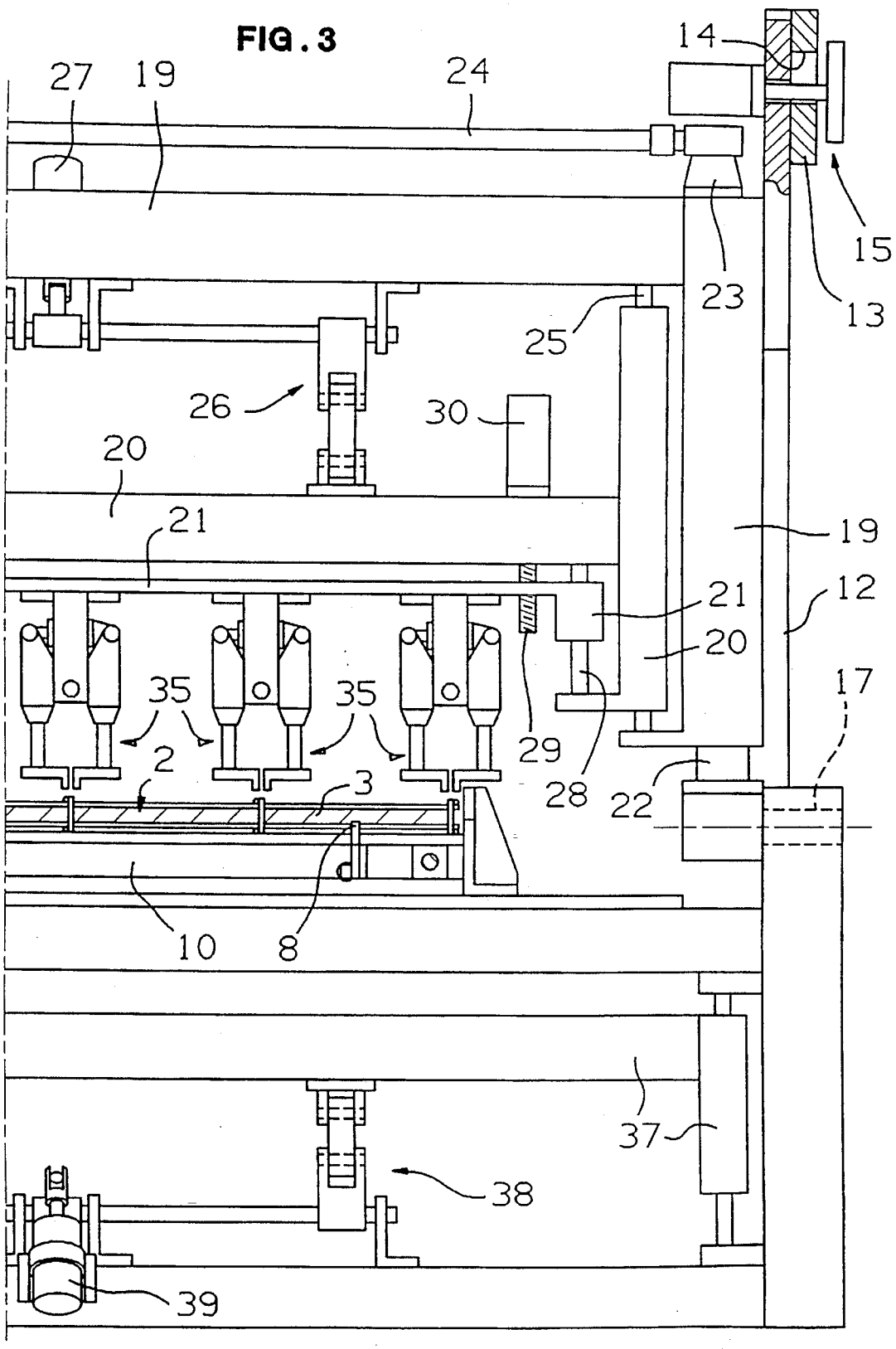
FIG. 3 is a partial front view of the automated equipment of FIGS. 1 and 2 with some of the components illustrated in FIG. 2 removed to facilitate viewing of components located behind them.

The tilting bridge 16 includes three span carriages reciprocally graduated and identified as the large carriage 19, the medium carriage 20 and the small carriage 21 (see also FIGS. 2 and 3).

The large carriage 19 slides on cylindrical guides 22 which have coaxial pins, not illustrated, screwed into them and driven through tapered couples 23 by a shaft 24. The large carriage 19 can be driven by a motor (not shown) to facilitate this sliding of the large carriage 19.

The medium carriage 20 is supported by the large carriage 19 and slides with respect to the latter on cylindrical guides 25 solidly attached to the large carriage 19 through a component with alternating movement 26 and driven by a pneumatic device 27.

The small carriage 21 is in turn supported by the medium carriage 20 and slides with respect to the latter on cylindrical guides 28 that are solidly attached to the medium carriage 20 by means of screw pins 29 driven by motorized units 30.

The large carriage 19, in addition to supporting the medium carriage 20, also supports in side-by-side relation, on a plane crosswise to the conveyor platform 1 of the panels 2, a number of guiding and straightening devices 31. Into each of the guiding and straightening devices 31 runs a pair of wires 32A, coming off a coil at the top (not illustrated) and coupled axially with respect to the direction of advance of the panels 2.

Below each guiding and straightening device 31, the large carriage 19 also supports devices 33, for pulling and inserting the wires 32A, as is more fully described hereinbelow.

The medium carriage 20, in addition to supporting the small carriage 21, also supports a number of cutting devices 34. The cutting devices 34 are located respectively below the pulling and inserting units 33 in continuation of the descending trajectory of the wire pairs 32A, which trajectory intersects the conveyor platform 1 of the panels 2 substantially at the point of the axis of hinge 17 of the tilting bridge 16 for purposes that will soon be apparent.

The small carriage 21 supports a number of upper welding devices indicated globally as 35, positioned coaxially one step behind the respective cutting devices 34 with reference to the direction of advance of the panels 2.

Beneath the panel conveyor platform 1 are a number of lower welding devices 36, respectively positioned so as to be substantially coaxial to the cutting devices 34. The welding devices 36 are supported vertically and are moved in alternation by a lower carriage 37 which is driven by an alternating motion component 38 driven by a pneumatic device 39.

Figure 4:
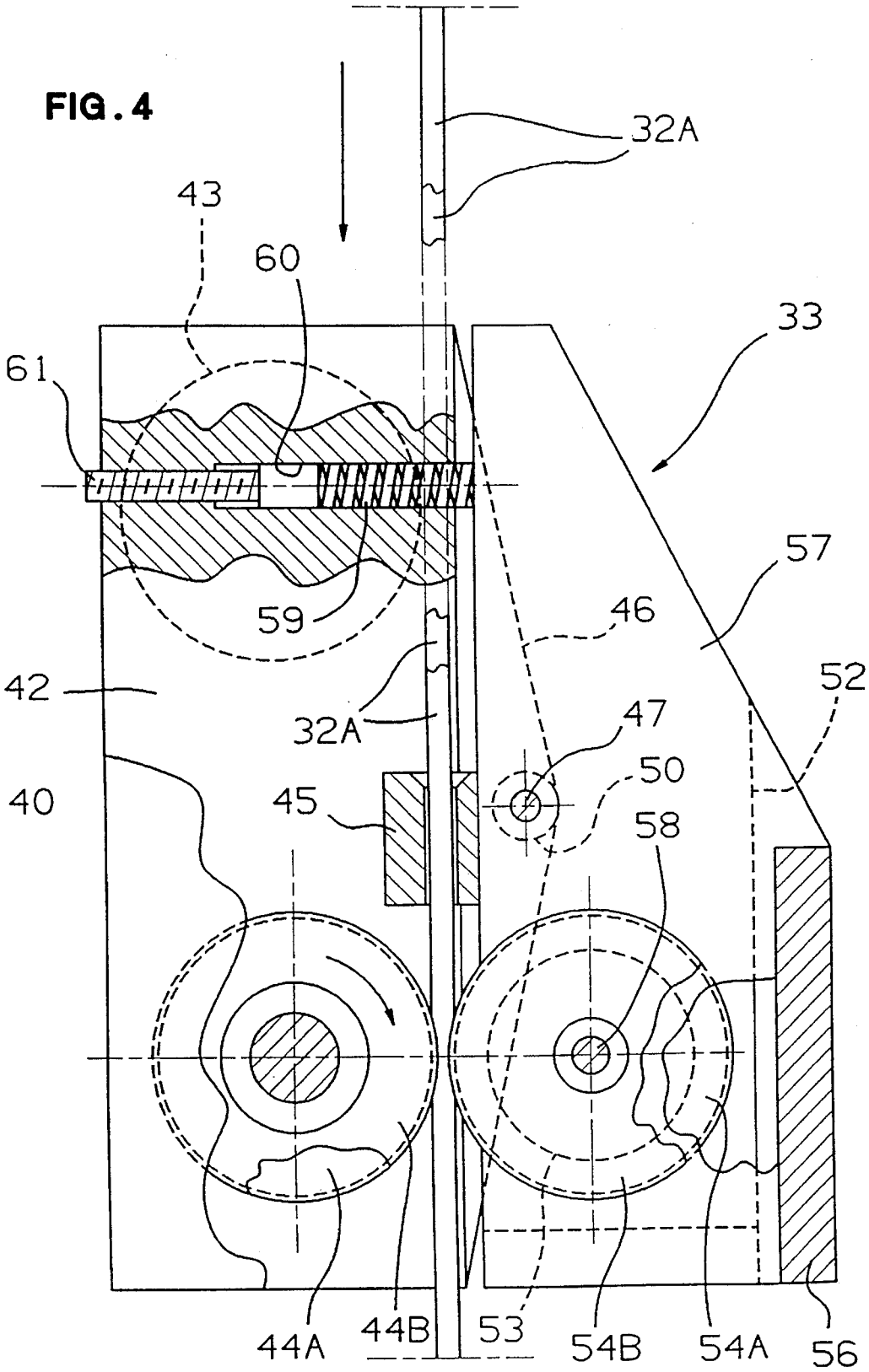
FIG. 4 is rear face view of a detail of the device according to this invention, with certain parts shown in cross-section and others removed for purposes of illustration.
Figure 5:
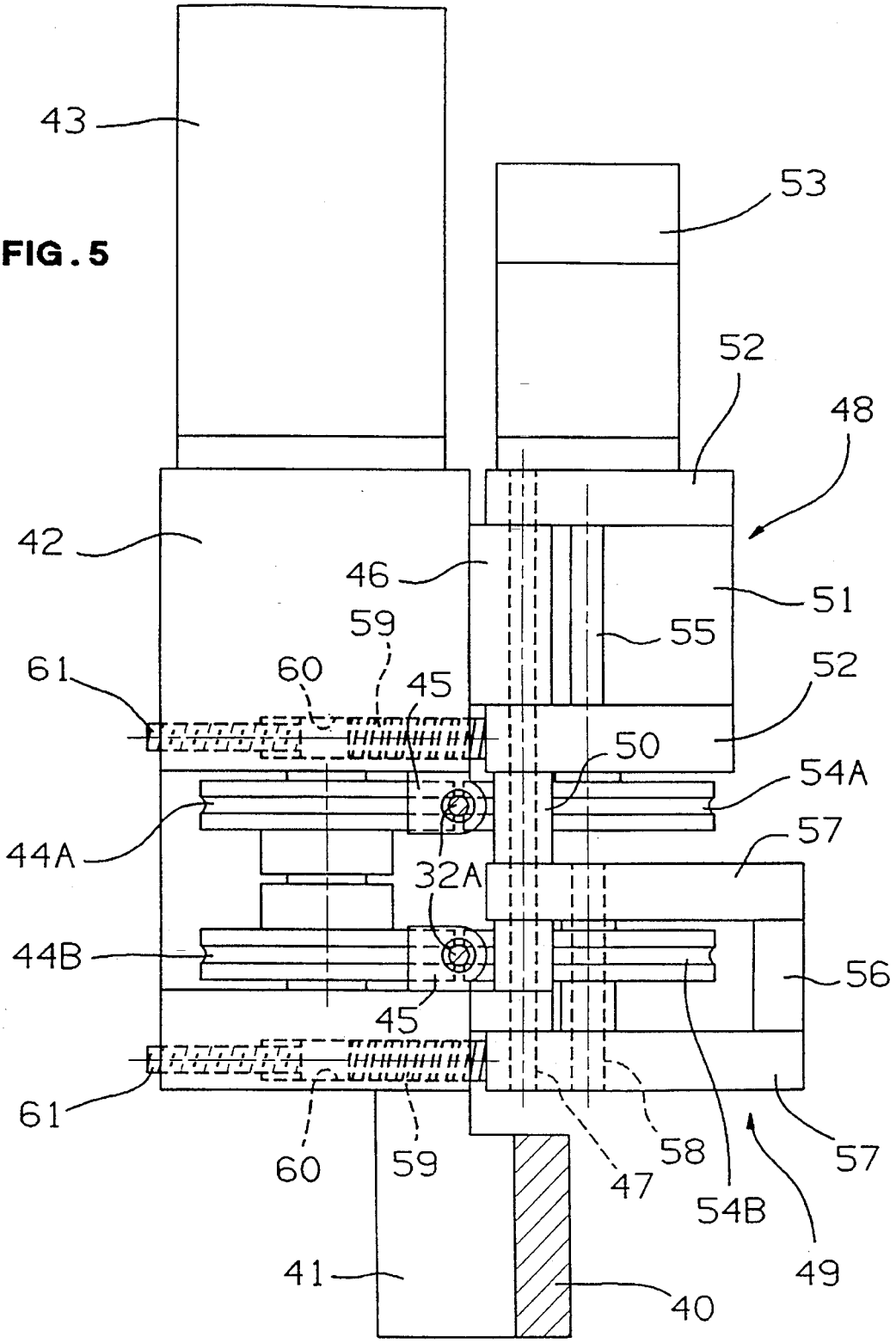
FIG. 5 is a top plan view of the same detail shown in FIG. 4.

The devices 33 for pulling and inserting the wires 32A are carried by the large carriage 19 by means of a support bearing 40 (see FIGS. 4 and 5). To support bearing 40 is affixed a plate 41 attached to a fixed block 42 containing reduction gearing (not shown) for transmitting rotary motion by means of "stepped" electric motor 43 powered by direct current to a coaxially twinned pair of wheels 44A, 44B grooved and, optionally, knurled around their peripheries' circumference. Tangent to each such periphery are positioned the wires 32A which, if necessary, may run in guides 45 solidly attached to the fixed block 42.

The block 42 has a vertically shaped projection 46 with symmetrical slopes. At the apex of the slopes is a pin 47 to which are consecutively hinged two pivoting forks 48, 49, that are separated by a spacer bushing 50.

The bottom 51 of the first fork 48 at which the tines 52 are connected is turned downward, the tines respectively supporting, below the hinge 47, an electronic revolution counter or "encoder" 53 and an idle wheel 54A connected by a pin 55. The idle wheel 54A has a groove, optionally knurled, about its circumference and the wheel is positioned so as to press a wire 32A against the drive wheel 44A.

The bottom 56 of the second fork 49 at which the tines 57 are connected is turned outward. Through the tines runs a pin 58 that is coaxial to the pin 55 of the first fork 48 and which supports a second idle wheel 54B. The second idle wheel 54B also has a groove, optionally knurled, around its circumference and is positioned so as to press another or separate wire 32A against the drive wheel 44B.

Above the hinge 47, one of the tines 52, 57 of each of the forks 48, 49 is matched by a spring 59 disposed within a hole 60 defined through the fixed block 42. Each spring 59 is adjustably compressed by means of the corresponding screws 61 to maintain the respective upper portions of the forks 48, 49 under a constant outward pressure. This constant outward pressure under the fulcrum formed by the hinge 47 produces an increase in pressure caused by the idle wheels 54A, 54B on the wires 32A against the counterforce exerted by the drive wheels 44A, 44B for the purposes described below.

Figure 6:
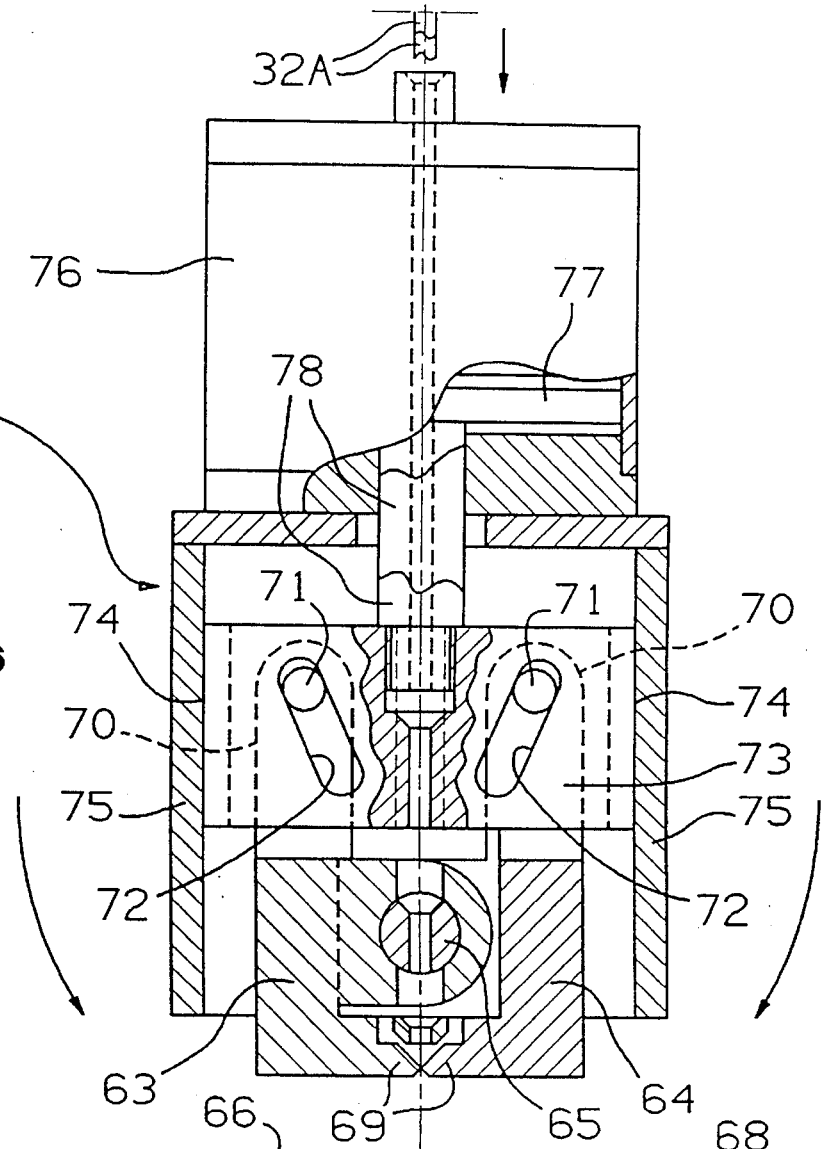
FIG. 6 is a partial vertical cross-section of another detail of the device according to this invention.
Figure 7:
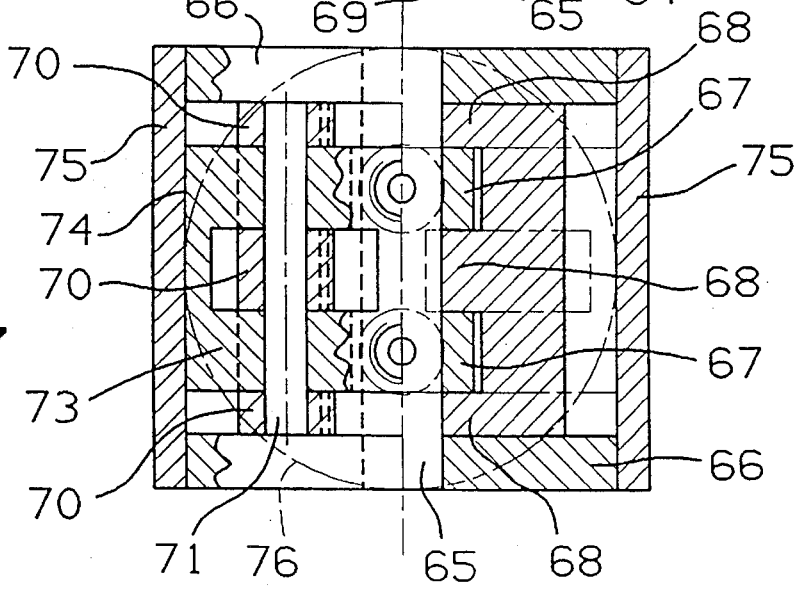
FIG. 7 section of the same detail shown in FIG. 6.

The cutting devices 34 (see FIGS. 6 and 7) are respectively carried by the medium carriage 20 through clamps 62 and each include a pair of jaws 63, 64 hinged on a pin 65 mounted horizontally between two walls 66.

The first jaw 63 has, in its articulation zone, a portion 67 shaped as a fork so as to permit it to be inserted into a portion with reeds 68 in the second jaw 64.

The jaws 63, 64 include cutting parts 69 at the bottom and operable for working together. The tops of the jaws 63, 64 extend into arms 70 equipped with cross pins 71 that respectively engage in slots 72 converging obliquely downward and formed a slide 73 that runs vertically on guides 74 supported by walls 75. The walls 75, with the walls 66, form a box-shaped casing of the cutting devices 34.

Above the box-shaped casing thus formed is a pneumatic cylinder 76 whose piston 77 is equipped with two shafts 78. The shafts 78 are connected to the slide 73. Pneumatic cylinder 76 is axially perforated to permit the passage of the wires 32A. Also for this purpose the slide 73 and the pin 65 have suitably positioned holes such that the wires 32A reach between the cutting parts 69 of the jaws 63, 64. Jaws 63, 64 are arranged to close by means of angular rotation effected by lowering the slide 73 under the control of the pneumatic device 76, thus cutting the wires 32A, through the reciprocal elongation of the pins 71 that engage the slots 72.

Operation of the Disclosed Embodiment

The panels 2 are caused to move or advance in a jogging motion on the conveyor platform 1 by the advancing device 7 so that each overlapping pair of transversal warp wires 5 of the netting 4 is positioned under the set of cutting devices 34 for the time necessary to carry out the following operations.

A length of parallel wires 32A is unrolled from each of the pulling and inserting devices 33 and inserted through the layer of expanded plastic 3 on both sides of the transversal warp wires 5 of the netting 4.

The wires 32A are unrolled by drive wheels 44A, 44B of the pulling devices 33 against the action of the respective idle wheels 54A, 54B, there pressed as needed by the pivoting forks 48, 49 with the load on the springs 59 appropriately regulated by the screws 61.

The length of the segment of wires 32A unrolled on a contingency basis is determined by an appropriate setting of the electronic encoder 53 which "reads" or detects the turns of the first idle wheel 54A. It should be noted that because the turns are induced, the first idle wheel does not experience slippage that could result in false readings by the encoder 53. The encoder 53 stops the electric motor 43 when the desired length of wires 32A has been unrolled.

At this point, the medium carriage 20 is lowered by the action of the alternating-movement component 26 driven by the pneumatic device 27. The bank of cutting devices 34 is therefore likewise lowered, with the mechanisms seen above and against a relative dynamic profile, to cut the pairs of wires 32A substantially at the point of the upper wire mesh 4. In this manner are isolated pairs of cross wires 32B which remain to pass through the layer of expanded plastic 3 on both sides of the transversal warp wires 5 (also see FIG. 8).

Simultaneously with the above-described lowering of the bank of cutting devices 34, the carriage 37 raises the bank of lower welding devices 36 which, with suitably shaped and dimensioned jaws, simultaneously weld the pairs of cross wires 32B to the lower wire netting 4.

Also at the same time, the bank of upper welding devices 35 is lowered by the medium carriage 20 together with the bank of cutting devices 34 one step behind the latter, where it welds the pairs of cross wires 32B cut as indicated to the upper wire mesh 4.

In the event of a change or variation in the format of the panels 2 to be operated upon, as for example using a thicker format, the entire bridge 16 may be raised to provide a sufficient opening on the conveyor platform 1 by raising the large carriage 19. In that case, the increased length of the cross wires 32B required to span the greater distance between the sheets of wire netting 4 can be obtained immediately and without the necessity of complex adjustments. This may for example be accomplished merely by changing the calibration of the electronic revolution counters or "encoders" 53 so that they accept a larger number of rotations of the wheels 54A of the pulling and insertion devices 33 without otherwise changing or adjusting any of the other parts or mechanisms of the apparatus.

Another advantageous feature of the device of the invention is that it is operable for inserting the pairs of cross wires 32B at a non-perpendicular angle to the panel wire nets 4.

By means of the motor mechanism 18 the entire bridge 16 may be caused to rotate on the hinges 17 until it is tilted at a user-selectable angle, and then there fixed by the air brakes 15 at any point on the slots 14 which, incidentally, are high enough to tolerate the full range of the large carriage 19.

The substantial coincidence of the axis of hinge 17 of the bridge 16 with the plane of insertion of most of the pairs of cross wires 32B permits the insertion of the wires to take place along an inclined trajectory. This occurs without modifications of any kind from that described above in connection with vertical insertion of the wires, and the same likewise applies to the action of the lower welding units 36.

On the other hand, the positioning of the upper welding units 35, which are one jogging step behind the panels 2 with respect to the hinge axis 17 of the bridge 16, means that the tilting of the bridge causes the welding devices to shift and, in particular, to move further away from the upper sheet of netting 4. However, this increased distance or spacing may be offset by adjusting the small carriage 21 so that only the bank consisting of these devices is able to slide.

Figure 9:
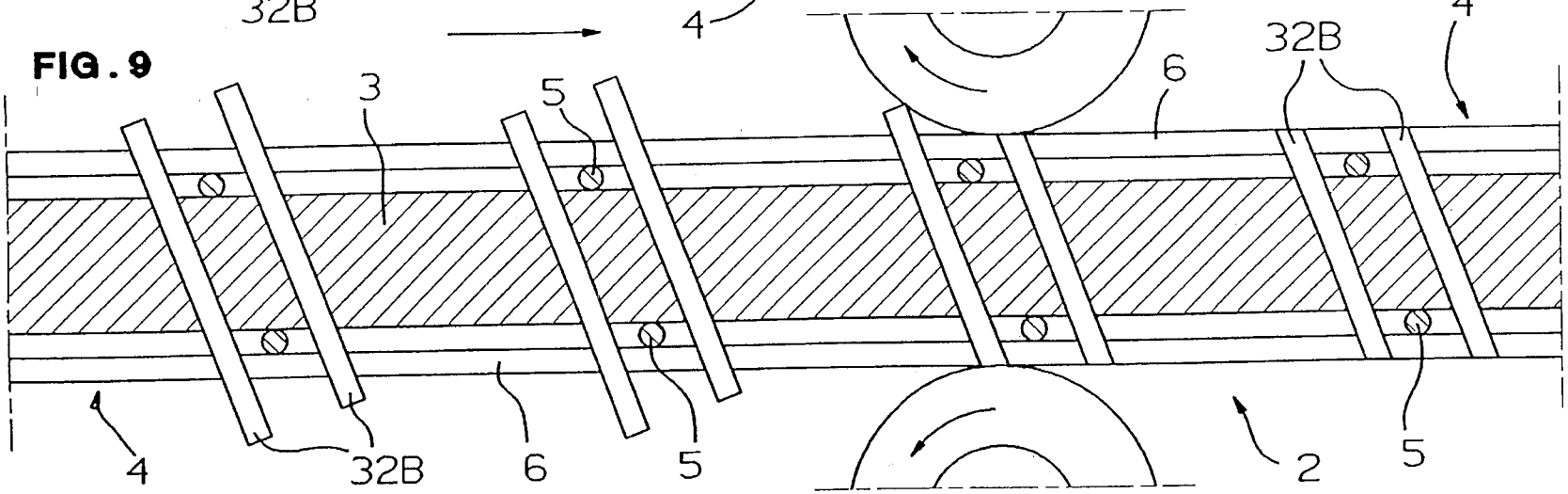
FIG. 9 is a side cross-sectional view of a sandwich panel formed of wire mesh and expanded plastic with pairs of cross wires inserted therethrough in accordance with another operating alternative of the device of the present invention.

The increased shifting of the pairs of cross wires 32B outside of the wire netting 4 as a result of the correspondingly tilted insertion (see FIG. 9) may be eliminated, if necessary or desirable, by a pair of rotating cutters or shears or the like as schematically illustrated in FIG. 9. The cutters may be positioned behind the battery of tipper welders 35 with reference to the direction of advance of the panels 2 on the conveyor platform 1.

The invention is not limited by the embodiments described above which are presented as examples only but can be modified in various ways within the scope of protection defined by the appended patent claims.

What is claimed is:

1. A device, in automated equipment for the prefabrication of sandwich building panels formed of an upper sheet of wire netting, a lower sheet of wire netting, and a sheet of expanded plastic material sandwiched between the upper and lower sheets of wire netting, for introducing wires crosswise through the building panels so as to form cross wires in the panels and for cutting the cross wires above the building panels so as to separate the cross wires from a feed supply of wire, comprising:

a substantially horizontal platform;

means for advancing a sandwich building panel on and along the platform in a forward jogging motion;

a pair of coaxially twinned wheels for pulling at least one line of wire and for inserting a portion of the at least one line of wire crosswise into the panel at each forward jogging motion of the panel;

adjustable means for driving said wheels for pulling and inserting, said adjustable means comprising at least one electric motor for driving said pair of coaxially twinned wheels;

a pair of rotatable idle wheels, said idle wheels and at least one of said coaxially twinned wheels being arranged in sufficient proximity for pressing therebetween the at least one line of wire; and means for counting revolutions of at least one of the idle wheels.

2. The device according to claim 1, further comprising:

a fixed block;

a reduction mechanism enclosed in said fixed block;

means for supporting said idle wheels and said means for counting revolutions; and a hinge for attaching said means for supporting the idle wheels and means for counting revolutions to said fixed block;

wherein said at least one electric motor is a stepped direct-current motor and is connected to said wheels for pulling and inserting by said reduction mechanism enclosed in said fixed block.

3. The device according to claim 2, further comprising springs disposed in said first block, and said hinge for attaching said means for supporting and said means for counting to said fixed block defining a fulcrum, wherein said fixed block includes a projection, wherein said means for supporting said idle wheels and said means for counting revolutions comprises a pair of forks attached by said hinge to the projection of the fixed block and supporting, on one side of said fulcrum, the idle wheels and the means for counting revolutions, said springs being located on another side of said fulcrum so as to press against said forks.

4. The device according to claim 1, further comprising means for cutting the at least one line of wire above the panel after insertion of the wire portion, so as to separate the inserted portion of the wire from the at least one line of wire.

5. The device according to claim 4, further comprising a pair of stems for axially passing two of the wires therethrough, a box shaped casing, a slide having slots, said slots having a top and a bottom and converging obliquely from said slot top to said slot bottom, said slide being movable substantially vertically in the box shaped casing, and a pneumatic device mounted with its vertical axis above said casing, wherein the means for cutting the at least one line of wire comprises a pair of jaws, said pair of jaws comprising a bottom of said jaws and cutting edges being located at said bottom of said jaws, arms extending upward from said bottom of said jaws, and cross pins passing through said arms to engage the slots and converge obliquely under the action of the pneumatic device.

6. A device, in automated equipment for the prefabrication of sandwich building panels formed of an upper sheet of wire netting, a lower sheet of wire netting, and a sheet of expanded plastic material sandwiched between the upper and lower sheets of wire netting, for introducing wires crosswise through the building panels so as to form cross wires in the panels and for cutting the cross wires above the building panels so as to separate the cross wires from a feed supply of wire, comprising:

a substantially horizontal platform;

means for advancing a sandwich building panel on and along the platform in a forward jogging motion;

wheels for pulling at least one line of wire and for inserting a portion of the at least one line of wire crosswise into the panel at each forward jogging motion of the panel;

adjustable means for driving said wheels for pulling and inserting;

a tiltable bridge for supporting said wheels and said adjustable means; and means for cutting the at least one line of wire above the panel after insertion of the wire portion so as to separate the inserted portion of the wire from the at least one line of wire.

7. The device according to claim 6, further comprising upper devices for welding the cross wires to the upper sheet of wire netting and located downstream of said means for cutting relative to a direction of advance of the panel along said platform, wherein said tiltable bridge comprises three reciprocally graduated and reciprocally mobile span carriages, said carriages comprising a small span carriage, a medium span carriage and a large span carriage, respectively, said span carriages being small, medium and large relative to each other, said medium span carriage supporting said small carriage, and said small carriage supporting said upper devices for welding.

8. The device according to claim 6, further comprising a plurality of said adjustable means for driving a plurality of said wheels for pulling and inserting a plurality of the wires, and a plurality of said means for cutting the wires, wherein said means for cutting are aligned on a plane transverse to a plane of advance of the panel.

9. The device according to claim 6, further comprising a pair of stems for axially passing two of the wires therethrough, a box shaped casing, a slide having slots, said slots having a top and a bottom and converging obliquely from said slot top to said slot bottom, said slide being movable substantially vertically in the box shaped casing, and a pneumatic device mounted with its vertical axis above said casing, wherein the means for cutting the at least one line of wire comprises a pair of jaws, said pair of jaws comprising a bottom of said jaws and cutting edges located at said bottom of said jaws, arms extending upward from said bottom of said jaws, and cross pins passing through said arms to engage the slots and converge obliquely under the action of the pneumatic device.

10. The device according to claim 6, wherein said tiltable bridge supports a plurality of said means for pulling and inserting and a plurality of said means for cutting the at least one wire, and said tiltable bridge being tiltable to planes transverse to a plane of advance of the panel, said bridge comprising stems that substantially lie in a plane of insertion of the wires into the panel, the bridge overhanging the platform and being hinged at said stems to said platform.

11. The device according to claim 6, wherein said tiltable bridge comprises an upper portion and comprises stems for attaching said tiltable bridge to said platform, further comprising a frame having an upper portion, a motor for tilting the tiltable bridge at least at one of the stems, and means for releasably securing said upper portion of said tiltable bridge to said upper portion of said frame, so as to permit said tiltable bridge to be held stationary at an angle to which it is tilted.

12. The device according to claim 11, wherein said upper portion of said frame has edges defining side slots and said means for releasably securing said upper portion of said tiltable bridge to said upper portion of said frame attaches said upper portion of said tiltable bridge to said edges of said side slots.

13. The device according to claim 6, wherein said tiltable bridge comprises three reciprocally graduated and reciprocally mobile span carriages, at least one of the carriages supporting the wheels for pulling and inserting the wires.

14. The device according to claim 13, wherein said three span carriages comprise a small span carriage, a medium span carriage and a large span carriage, respectively, said carriages being small, medium and large, relative to each other, and the means for pulling and inserting the wires being supported by said large span carriage and said cutting devices being supported by said medium carriage.

15. The device according to claim 6, wherein said wheels for pulling and inserting comprise a pair of coaxially twinned wheels;

further comprising a pair of rotatable idle wheels, said idle wheels and at least one of said coaxially twinned wheels being arranged in sufficient proximity for pressing therebetween the at least one line of wire; and means for counting revolutions of at least one of the idle wheels;

wherein said adjustable means comprises at least one electric motor for driving said pair of coaxially twinned wheels.

16. The device according to claim 15, further comprising:

a fixed block;

a reduction mechanism enclosed in said fixed block;

means for supporting said idle wheels and the means for counting revolutions; and a hinge for attaching said means for supporting said idle wheels and said means for counting revolutions to said fixed block;

wherein the at least one electric motor is a stepped direct-current motor and is connected to said wheels for pulling and inserting by said reduction mechanism enclosed in said block.

17. The device according to claim 16, further comprising springs disposed in said first block, and said hinge for attaching said means for supporting and said means for counting to said fixed block defining a fulcrum, wherein said fixed block includes a projection, wherein said means for supporting the idle wheels and said means for counting revolutions comprises a pair of forks attached by the hinge to the projection of the fixed block and supporting, on one side of the fulcrum, the idle wheels and the means for counting revolutions, said springs being located on another side of the fulcrum so as to press against said forks.

* * * * *